US005264000A

United States Patent [19]

Lauton et al.

[11] Patent Number: 5,264,000

[45] Date of Patent: Nov. 23, 1993

[54] AQUEOUS SOLUTIONS OF SYNTHETIC TANNING AGENTS

[75] Inventors: Alain Lauton, Saint-Louis, France; Alois Püntener, Rheinfelden, Switzerland

[73] Assignee: Ciba-Geigy Corporation, Ardsley, N.Y.

[21] Appl. No.: 709,904

[22] Filed: Jun. 3, 1991

Related U.S. Application Data

[63] Continuation of Ser. No. 360,578, Jun. 1, 1989, abandoned.

[30] Foreign Application Priority Data

Jun. 6, 1988 [CH] Switzerland ..... 2137-88

[51] Int. Cl.[5] ..... C14C 3/18; C14C 3/20

[52] U.S. Cl. ..... 8/94.24; 8/94.19 R; 8/94.27; 8/94.28; 8/94.29; 252/8.57

[58] Field of Search ..... 8/94.19 R, 94.24, 94.27, 8/94.28, 94.29; 528/150, 99; 252/8.57

[56] References Cited

U.S. PATENT DOCUMENTS 3,423,452 1/1969 Lipowski ..... 8/94.24

4,830,632 5/1989 Lauton ..... 8/94.33

FOREIGN PATENT DOCUMENTS 1296304 11/1972 United Kingdom .

OTHER PUBLICATIONS

Encyclopedia of Chemical Technology, vol. 12, pp. 325–329, 2nd edition, 1967.

*Primary Examiner*—Prince Willis, Jr.

*Assistant Examiner*—Alan D. Diamond

*Attorney, Agent, or Firm*—Kevin T. Mansfield; Edward McC. Roberts

[57] ABSTRACT

Aqueous solutions of synthetic tanning agents comprising (A) a lithium salt of a synthetic, anionic aromatic tanning agent or the anionic non-condensed precursor thereof, and, as optional components, (B) a water-soluble chromium, aluminum, iron or zirconium salt or a mixture thereof, and (C) an alkali metal salt of ethylenediaminetetraacetic acid or of a pyrophosphate are prepared by mixing an aqueous solution of component (A) and optional component (C) with component (B), which may also be in the form of an aqueous solution, and are used as tanning agents for tanning bides or for retanning leather of all kinds. The lithium salts used as component (A) are novel and can be used as stain blockers for polyamide fibres or for enhancing the wetfastness properties of dyeings on polyamide fibres.

15 Claims, No Drawings

AQUEOUS SOLUTIONS OF SYNTHETIC TANNING AGENTS

This is a continuation of Ser. No. 360,578 filed Jun. 1, 1989 now abandoned.

The present invention relates to aqueous solutions of synthetic tanning agents, to the use thereof for tanning hides and retanning leather, as well as to lithium salts of said tanning agents.

In aqueous solutions, tanning agents are usually in the form of ammonium salts. These salts are malodorous for the end user to handle and they also cause pollution of the effluents resulting from their use.

It has now been found that tanning agents in the form of their lithium salts do not have these drawbacks.

Accordingly, the present invention relates to an aqueous solution of a synthetic tanning agent, which solution comprises (A) a lithium salt of a synthetic, anionic aromatic tanning agent or the anionic non-condensed precursor thereof, and, as optional components, (B) a water-soluble chromium, aluminium, iron or zirconium salt or a mixture thereof, and (C) an alkali metal salt of ethylenediaminetetraacetic acid or of a pyrophosphate.

The synthetic aromatic tanning agent of component (A) are known per se, for example from Ullmanns Enzyklopädie der technischen Chemie, Vol. 16, (4), pp. 138–140, (1979).

The lithium salts eligible for use in the practice of this invention are novel and constitute a further object of the present invention.

Particularly interesting lithium salts are those of synthetic, anionic aromatic tanning agents (also known as anionic aromatic syntans) as well as their anionic non-condensed precursors.

Examples of suitable precursors are naphthalene, diphenyl, terphenyl, phenols, cresols, 4,4'-dihydroxydiphenyl sulfone, β-naphthol, dihydroxybenzenes, resorcinol, 2,2'-bis(hydroxyphenyl)propane and diaryl ethers such as diphenyl ether and ditolyl ether, which compounds can be sulfonated to the anionic non-condensed precursors in a manner known per se.

Suitable anionic aromatic syntans are those which are obtainable by condensation of the sulfonated precursors alone or together with further, usually unsulfonated precursors with formaldehyde and/or urea, for example:

(I) condensates of sulfonated phenol or cresol and formaldehyde, (II) condensates of naphthalenesulfonic acid and formaldehyde, (III) formaldehyde condensates of 4,4'-dihydroxydiphenyl sulfones with (hydroxy)arylsulfonic acids, (IV) formaldehyde condensates of sulfonated aromatic hydroxy compounds with aralkyl halides, (V) urea/formaldehyde condensates of phenols and phenolsulfonic acids, (VI) reaction product of phenol and a sulfonating agent in which the molar ratio of (phenol): ($SO_3$) is (1): (1.1–2.2), (VII) condensates of sulfonated diaryl ethers and formaldehyde, (VIII) condensates of sulfonated diphenyls or terphenyls and formaldehyde, (IX) condensates of 4,4'-dihydroxydiphenyl sulfone and sulfonated 4,4'-dihydroxydiphenyl sulfone with formaldehyde, and (X) formaldehyde condensates of diaryl ether sulfonic acid and 4,4'-dihydroxydiphenyl sulfone.

The condensates of types (I)–(III), (V) and (VII)–(X) are known, for example from Ullmanns Enzyklopädie der technischen Chemie, Vol. 16 (4), 140, 1979, and can be prepared by the methods described in the references cited therein.

Condensates of type (IV) and the preparation thereof are disclosed in GB patent specification 986 621.

Condensates of type (v) and the preparation thereof are disclosed in GB patent specifications 890 150 and 935 678.

The reaction product of type (VI) and the preparation thereof are disclosed in European patent application 0 245 205. This reaction product can be condensed by methods known per se to condensates of type (V) (q.v. GB patent specification 683 084).

The ready-for-use tanning salts suitable for use as component (B) are described in the relevant literature. They are normally chromium, aluminium, iron or zirconium salts. Typical examples of such salts are basic chromium(III) chloride or basic chromium(III) sulfate, a chrome alum, basic or acidic aluminium chloride or sulfate, an alum, iron(III) chloride or iron(III) sulfate, zirconium oxychloride and zirconium sulfate. Mixtures of the above chromium and aluminium salts are also very suitable for use as component (B). Preferred salts are:

$[CrCl_2(OH_2)_4]Cl \cdot 2\ H_2O$, $[Cr(OH_2)_6]Cl_3$, $Cr(OH)SO_4$, $Cr_2(OH)_4SO_4$, $KCr(SO_4)_2 \cdot 12\ H_2O$, $AlCl_3 \cdot 6\ H_2O$, $Al_2(SO_4)_3 \cdot 16\ H_2O$, $Al_2(OH)_4SO_4$, $Al(OH)_2Cl$, $Al(OH)Cl_2$, $KAl(SO_4)_2 \cdot 12\ H_2O$, $Fe_2(SO_4)_3 \cdot 9\ H_2O$, $Zr(OH)_2SO_4$, $ZrOCl_2 \cdot 8H_2O$ and $Zr(SO_4)_2 \cdot 4\ H_2O$.

Preferred salts are the basic chromium sulfates $Cr(OH)SO_4$ and $Cr_2(OH)_4SO_4$, which are obtainable from chromium alum and an alkali in an equivalent ratio of 3:1 to 3:2.

If the optional component (C) is concurrently used in the composition of this invention, tetrasodium ethylenediaminetetraacetate or neutral or acid sodium pyrophosphate ($Na_4P_2O_7$ or $Na_2H_2P_2O_7$) may suitably be employed. The optional component (C) acts as complexing agent and is preferably added to the composition if an iron-free tanning agent is used, provided the iron content of the oleum used in the preparation of component (A) is relatively high.

As the tanning salts of the type suitable for use as component (B) have widely differing molecular weights, in the weight ratio of component (A) to component (B) the weights of component (B) are preferably based on the metal atom of the appropriate tanning salt. In addition, when using chromium tanning salts as component (C), not more than 0.375 part of chromium may be used per part of component (A). Larger amounts of chromium would be no longer soluble in the composition and would lead to inhomogenous compositions. Preferred compositions thus contain components (A) and (B) in a weight ratio of (A):(B) of (1):(0.03 to 0.5), based on the metal atom of the component (B), such that not more than 0.375 part of chromium is present. Compositions which have as high a content of tanning salt as possible are preferred, as the tanning salts of component (B) are cheaper than the reaction product of phenol and oleum used as component (A), the tanning action of the composition being based on component (A) as well as on component (B). Compositions which contain components (A) and (B) in a weight ratio of (A):(B) of (1):(0.3 to 0.375) are therefore particularly preferred.

If optional component (C) is used concurrently, the addition of 0.04 part by weight of component (C) per part by weight of component (A) is sufficient to achieve the complexing activity of component (C). The compositions will thus normally contain components (A) and (C) in a weight ratio of (A):(C) of (1): (0 to 0.04).

A solution of this invention which is diluted with water to 1 %, based on the solids content of component (A) and optional components (B) and (C), has a pH of not more than 5. The 1 % aqueous solutions of compositions of this invention preferably have a pH in the range from 0 to 3.5.

In general, the compositions of the present invention have a water content of 40 to 80,preferably of 45 to 62, percent by weight.

The preparation of the composition of the present invention generally comprises first mixing an aqueous solution of component (A) and optional component (C) with component (B), which may also be in the form of an aqueous solution. Before mixing it with optional component (C), component (A) should for safety reasons be first diluted with water to give 50 to 70 percent by weight solutions of component (A). In this case, optional component (C) is slowly added to the aqueous solution of component (A).

Only as a final step is component (B) added to the mixture of component (A) and optional component (C). In this step, component (C) may be added in solid form with vigorous stirring. This is especially the case when using, for example, aluminium tanning salts as component (B). When using chromium tanning salts it has, however, proved particularly advantageous to add component (B) as an aqueous solution, in which case said aqueous solution is usually heated to 60° to 90° C. before admixture with component (A) and optional component (C). After mixing all components, the composition will normally be diluted with water to the preferred water content of 40 to 80 percent by weight.

The aqueous solution of synthetic tanning agents of this invention preferably comprise 5 to 60 % by weight of component (A),
0 to 60 % by weight of component (B),
0 to 60 % by weight of component (C), and
water to make up 100 % by weight.

The resultant compositions of the present invention are fluid and are especially suitable for tanning hides or for retanning all types of leather.

Tanning is effected by conventional methods by treating bides or pretanned leather with an aqueous solution containing the aqueous composition of the present invention, and subsequently finishing the tanned material in conventional manner, for example by neutralization, rinsing, fatliquoring and drying. If desired, a dyeing process may be carried out. Normally 100 to 200, preferably 140 to 180, parts by weight of water and 5 to 40 parts by weight of the aqueous composition of the invention are used per 100 parts by weight of hide or leather. In particular, 100 parts by weight of preferably delimed hides are tanned with 140 to 160 parts by weight of water and 10 to 20 parts by weight of the composition of the invention, or 100 parts by weight of conventionally chrome tanned leather which has been neutralized, for example, with formate or bicarbonate, is post-tanned with 140 to 160 parts by weight of water and 5 to 15 parts by weight of the composition of the invention. The tanned material is rinsed and, if desired, fatliquored with a conventional fatliquoring agent based on, for example, sulfonated fish oil, sperm oil or neat's foot oil. After drying, a light, brilliant leather having good light fastness properties and a firm, compact, smooth grain and a soft handle is obtained.

In addition to imparting the above mentioned good properties of the tanned material, the composition of the present invention also has the important advantage that it is particularly stable during storage. Even after storage for several months, no turbidity or flocculation of the composition can be observed.

In addition, the lithium salts of this invention can also be used for enhancing the wetfastness properties of dyeings produced on polyamide fibres or as stain blockers.

Furthermore, the lithium salts can also be used as dispersants, especially for dyes and chemicals.

The novel lithium salts are also prepared by neutralising the anionic syntans with lithium hydroxide or lithium hydroxide monohydrate.

In the following Preparatory Instruction and subsequent Examples, parts and percentages are by weight.

Process for the preparation of component (A)

Instruction A 136.5 parts of phenol (1.45 mol) are fused at 450° C. 193.4 parts of 20 % oleum (2.08 mol of $SO_3$) are slowly added to this melt such that the temperature of the reaction mixture does not rise above 160° C. The reaction mixture is then stirred under reduced pressure at 26 mbar and at 160° C. for six hours, during which time the water of reaction together with small amounts of phenol melt are removed azeotropically from the reaction mixture. Subsequently the reaction mixture is cooled under normal pressure to 40° C., to give 253 parts of a melt of a mixture of polyhydroxy-polyphenylsulfonesulfonic acids containing the disulfonic acid of formula

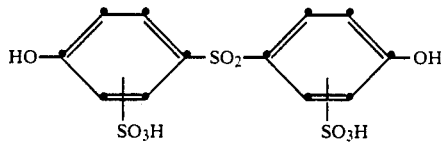

(1)

as main component.

PREPARATORY EXAMPLES

Example 1

To 500 parts of fused phenol are slowly added 440 parts of 66% oleum at 60° C.-700° C., and the mixture is subsequently sulfonated for 1 hour at 100° C. The resultant phenolsulfonic acid is then slowly heated to 160° C.-165° C. under a vacuum of about 14-17 mbar, such that only a small amount of phenol is distilled, and is kept at this temperature until 1 g of the condensate neutralizes to Congo red 35 to 37 $cm^3$ of 1N aqueous sodium hydroxide. To the condensate so obtained are added 90-100 parts of phenol and, as soon as the phenol has been thoroughly mixed, the reaction mass is again slowly heated at 165° C. under vacuum until 1 g of the condensate neutralizes to Congo red only 2.7 to 2.5 $cm^3$ of 1N aqueous sodium hydroxide solution. Yield: 900-940 parts.

82 parts of the above condensate are diluted with 36 parts of water and the solution is neutralised with 16.2 parts of lithium hydroxide monohydrate. After addition of 13.1 parts of 37 % formaldehyde, condensation is carried out at 100° C.-105° C. until a sample, diluted with a small amount of water, remains clear after acidification with dilute sulfuric acid (ca. 6 hours). The reaction mass is then diluted with 50 parts of water and the resultant tanning agent is adjusted to pH 3.5 with 13 parts of 40 % sulfuric acid and acidified with 14 parts of 85% of formic acid. The clear, stable tanning agent solution so obtained has a total solids content of ca. 47 %. This tanning agent is most suitable for the preparation of white leather.

Example 2

To a solution of 70 parts of the reaction product of phenol and oleum prepared according to Instruction A are slowly added 30 parts of water and the pH is adjusted to 3.5 with 20 parts of lithium hydroxide monohydrate. The temperature of the reaction mixture should not exceed 70° C. The resultant solution is acidified with 10 parts of 75% acetic acid (total solids content ca. 56%). Full-grained chrome leather treated with this tanning agent solution in conventional manner has a full grain and a soft handle.

Example 3

To a solution of 166.5 parts of the reaction product of phenol and oleum prepared according to Instruction A, 100 parts of water and 4 parts of tetrasodium ethylenediaminetetraacetate are slowly added 4.5 parts of lithium hydroxide monohydrate, such that the temperature of the reaction mixture does not exceed 70° C. The reaction mixture is kept at 70° C. for 15 minutes, with stirring, to form a clear solution. A solution, preheated to 70° C., of 198 parts of $Cr(OH)SO_4$ (corresponding to 62.3 parts of chromium) in 360.5 parts of water is then added to the reaction solution. Thereafter the reaction solution is kept for 20 minutes at 70° C., with stirring, then diluted with 166.5 parts of water and cooled to 20° C. The composition remains homogeneous after storage for 3 months, i.e. no turbidity or flocculation occurs.

Example 4

To a solution of 150 parts of a reaction product obtained by heating 51 parts of a mixture of naphthalenesulfonic acids, 51 parts of 4,4'-dihydroxydiphenyl sulfone, 25 parts of water and 23 parts of a 30% solution of formaldehyde are slowly added 1.5 parts of tetrasodium pyrophosphate and 20 parts of water, and the pH of the mixture is adjusted to 3.5 with 11.5 parts of lithium hydroxide monohydrate. The temperature of the reaction mixture should not exceed 70° C. The resultant solution is acidified with 20.9 parts of 75% acetic acid (total solids content ca. 57%).

The procedures described in Examples 1, 2 and 4 are repeated, using the condensates (II), (IV), (V) and (VII) to (X), to give the corresponding lithium salts.

APPLICATION EXAMPLES

Example A 100 parts of delimed calf hide are treated with 150 parts of water and 51 parts of the composition prepared according to Example 1 for 24 hours at 20° C. in a revolving drum. The treated hide is washed, fatliquored, racked, dried, conditioned, staked and tacked to give a white tanned leather having a full grain and a soft handle.

Example B 100 parts of shaved chrome-tanned calf leather are treated with 150 parts of water and 10 parts of the composition prepared according to Example 3 for two hours in a revolving drum at 50° C. After rinsing, the leather is neutralized in conventional manner with sodium formate and sodium bicarbonate, washed, dyed with one part of the leather dyeing agent C.I. Acid Brown 189 and after-treated with a conventional fatliquoring agent based on sulfonated fish oil. Finishing the leather as described in Example A gives a retanned, brown, brilliant leather which also has a full grain and a soft handle.

Example C 100 parts of a polyamide carpet are treated for 15 minutes at 60° C. with an aqueous solution which comprises 5 parts of the lithium salt obtained according to Example 4, 1 part of magnesium sulfate, and 5 parts of ammonium acetate, and which bas been adjusted to pH 2.5 with formic acid. The treated carpet is then rinsed with cold water and dried. The treated carpet has no affinity at room temperature for C.I. FD&C Red 40.

Example D 100 g of polyamide 66 tricot fabric are put at 40° C. into a liquor (liquor to goods ratio 1:40) which contains 2 g of a commercially available anionic levelling agent and 1.2 g of a dye, and which is adjusted with acetic acid to pH 5. With constant circulation of the liquor, the dyebath is heated to 98° C. over 30 minutes and dyeing is carried out at this temperature for 30 minutes. The dyebath is then cooled and the substrate is rinsed. The substrate is then put at 70° C. into a liquor (liquor to goods ratio 1:40) which contains 3 g of the condensate of 4,4'-dihydroxydiphenyl sulfone and sulfonated phenol with formaldehyde and which is adjusted with acetic acid to pH 4. The substrate is treated at 70° C. for 15 minutes and the bath is then cooled. The substrate is rinsed and dried. The tricot fabric has enhanced wetfastness properties.

We claim:

1. An aqueous solution of a synthetic tanning agent, which comprises (A) 5 to 60% by weight of a lithium salt of a synthetic, anionic aromatic tanning agent selected from the group consisting of (I) a condensate of sulfonated phenol or cresol and formaldehyde, (II) a naphthalenesulfonic acid/formaldehyde condensate, (III) a formaldehyde condensate of a aromatic hydroxy compound with an aralkyl halide, (IV) an urea/formaldehyde condensate of a phenol or phenolsulfonic acid, (V) a condensate of a sulfonated diaryl ether and formaldehyde, (VI) a condensate of sulfonated diphenylene or terphenylene and formaldehyde, (VII) a condensate of 4,4'-dihydroxydiphenyl sulfone and sulfonated 4,4'-dihydroxydiphenyl sulfone with formaldehyde, and (VIII) a condensate of a diaryl ether sulfonic acid and 4,4'-dihydroxydiphenyl sulfone and formaldehyde, (B) 0.03 to 0.50 parts weight, calculated as the metal atom of the component (B), of a water-soluble chromium, aluminum, iron or zirconium salt or a mixture thereof, per part of component (A), provided that not more than 0.375 part of chromium is present, (C) 0 to 60% by weight of an alkali metal salt of ethylenediaminetetraacetic acid or of a pyrophosphate, and water to make up 100% by weight.

2. An aqueous solution according to claim 1, wherein component (A) comprises a condensate of sulfonated phenol or cresol and formaldehyde.

3. An aqueous solution according to claim 1, wherein component (A) comprises a naphthalenesulfonic acid/formaldehyde condensate.

4. An aqueous solution according to claim 1, wherein component (A) comprises a formaldehyde condensate of a sulfonated aromatic hydroxy compound with a aralkyl halide.

5. An aqueous solution according to claim 1, wherein component (A) comprises an urea/formaldehyde condensate of a phenol or phenolsulfonic acid.

6. An aqueous solution according to claim 1, wherein component (A) comprises a condensate of a sulfonated diaryl ether and formaldehyde,

7. An aqueous solution according to claim 1, wherein component (A) comprises a condensate of sulfonated diphenylene or terphenylene and formaldehyde.

8. An aqueous solution according to claim 1, wherein component (A) comprises a condensate of 4,4'-dihydroxydiphenyl sulfone and sulfonated 4,4'-dihydroxydiphenyl sulfone with formaldehyde.

9. An aqueous solution according to claim 1, wherein component (A) comprises a condensate of a diaryl ether sulfonic acid and 4,4'-dihydroxydiphenyl sulfone and formaldehyde.

10. An aqueous solution according to claim 1, wherein component (B) is present at 0.3 to 0.375 parts weight, calculated as the metal atom of the component (B), per part of component (A).

11. An aqueous solution according to claim 1, wherein component (C) is present at 0 to 0.04 parts weight per part of component (A).

12. An aqueous solution according to claim 1, wherein component (B) is a basic chromium(III) chloride or basic chromium(III) sulfate, a chrome alum, basic or acidic aluminum chloride or sulfate, an alum, iron(III) chloride or iron(III) sulfate, zirconium oxychloride or zirconium sulfate or a mixture of said chromium or aluminum salts.

13. An aqueous solution according to claim 12, wherein component (B) is selected from the group consisting of $[CrCl_2(OH_2)_4]Cl \cdot 2\ H_2O$, $[Cr(OH_2)_6]Cl_3$, $Cr(OH)SO_4$, $Cr_2(OH)_4SO_4$, $KCr(SO_4)_2 \cdot 12\ H_2O$, $AlCl_3 \cdot 6\ H_2O$, $Al_2(SO_4)_3 \cdot 16\ H_2O$, $Al_2(OH)_4SO_4$, $Al(OH)_2Cl$, $Al(OH)Cl_2$, $KAl(SO_4)_2 \cdot 12\ H_2O$, $Fe_2(SO_4)_3 19\ 9\ H_2O$, $Zr(OH)_2SO_4$, $ZrOCl_2 \cdot 8\ H_2O$ and $Zr(SO_4)_2 \cdot 4\ H_2O$.

14. An aqueous solution according to claim 1, wherein component (C) is the tetrasodium salt of ethylenediaminetetraacetic acid or neutral or acid sodium pyrophosphate.

15. A process for tanning hides or for retanning leather which comprises applying to them an aqueous solution as claimed in claim 1.

* * * * *